US008789809B2

(12) United States Patent
Lehmann

(10) Patent No.: US 8,789,809 B2
(45) Date of Patent: Jul. 29, 2014

(54) AUXILIARY DEVICE FOR ALIGNMENT OF FLOOR BOARDS WHEN LAYING PLANK FLOORING

(75) Inventor: Christian Lehmann, Wuppertal (DE)

(73) Assignee: Spax International GmbH & Co. KG, Ennepetal (DE)

( * ) Notice: Subject to any disclaimer, the term of this patent is extended or adjusted under 35 U.S.C. 154(b) by 63 days.

(21) Appl. No.: 13/588,144

(22) Filed: Aug. 17, 2012

(65) Prior Publication Data

US 2013/0048926 A1 Feb. 28, 2013

(30) Foreign Application Priority Data

Aug. 25, 2011 (DE) ..... 20 2011 051 107 U

(51) Int. Cl.

| | |
|---|---|
| ***B66F 3/02*** | (2006.01) |
| ***B66F 3/00*** | (2006.01) |
| ***E04D 15/00*** | (2006.01) |
| ***E04F 21/00*** | (2006.01) |
| ***E04G 21/14*** | (2006.01) |
| *E04F 21/22* | (2006.01) |

(52) U.S. Cl.
USPC ..... 254/17; 254/12; 254/15; 52/749.1

(58) Field of Classification Search
USPC ..... 254/17, 12, 15, 16; 52/749.1, 747.1, 52/127.6
See application file for complete search history.

(56) References Cited

U.S. PATENT DOCUMENTS

| | | | | |
|---|---|---|---|---|
| 2,518,586 A | | 8/1950 | Williamson | |
| 5,419,535 A | * | 5/1995 | Roberts et al. | 254/15 |
| 5,456,053 A | * | 10/1995 | Fischer | 52/749.1 |
| 5,788,221 A | * | 8/1998 | Muhlebach et al. | 254/16 |
| 5,894,705 A | | 4/1999 | Sutton | |
| 6,233,899 B1 | * | 5/2001 | Mellert et al. | 52/747.1 |
| 6,615,553 B2 | * | 9/2003 | Omundson | 52/127.5 |
| 6,971,635 B1 | * | 12/2005 | Foster | 254/17 |
| 8,201,343 B2 | * | 6/2012 | Morris | 33/613 |
| 8,434,738 B1 | * | 5/2013 | Anstett | 254/12 |
| 2010/0180986 A1 | * | 7/2010 | Pelc, Jr. | 144/270 |

FOREIGN PATENT DOCUMENTS

| | | |
|---|---|---|
| CA | 2165752 | 6/1997 |
| DE | 10 2008 018 072 B3 | 3/2009 |
| EP | 0 808 8964 A2 | 5/1997 |

OTHER PUBLICATIONS

European Search Report—Dec. 28, 2011.

* cited by examiner

*Primary Examiner* — Lee D Wilson
*Assistant Examiner* — Alvin Grant
(74) *Attorney, Agent, or Firm* — Brinks Gilson & Lione

(57) ABSTRACT

Disclosed is an auxiliary device (1) for alignment of floor boards (2) when laying plank flooring. The auxiliary device is a tensioning unit (10) with two floor-side, protruding, lower contact jaws (12, 14) for resting against board side edges. The contact jaws are joined together via a displacement guide (16) for changing of their mutual internal distance (X1, X2), and with an upper lever mechanism (18) positioned opposite the lower, floor-side contact jaws (12, 14). The lever mechanism (18) is designed according to the toggle principle and is connected to the contact jaws (12, 14) such that by pivoting of the lever mechanism (18) the contact jaws (12, 14) can be moved from a starting position with a larger distance (X1) into a tensioned position with a smaller, defined distance (X2).

10 Claims, 4 Drawing Sheets

10
12
44
48
46
46
46
20
X2
24
50
30
28
26
18
36
40
42
26a
19
32
16a
16
22
14
X
1

10
12
44
48
19
46
46
20
X1
50
28
34
18
32
24
26
30
38
36
40
26a
42
16a
20
16
19
22
14
1

AUXILIARY DEVICE FOR ALIGNMENT OF FLOOR BOARDS WHEN LAYING PLANK FLOORING

CROSS REFERENCE TO RELATED APPLICATION

This application claims priority to German patent application number 20 2011 051 107.3.

TECHNICAL FIELD OF THE INVENTION

The present invention relates to an auxiliary device for alignment of floor boards when laying plank flooring.

BACKGROUND OF THE INVENTION

In the laying of plank flooring a problem frequently encountered is that the floor boards are not ideally straight, but rather display an undefined curvature. Therefore in practice a straight and true floor board is first secured to a floor-sub-floor. Then the additional boards must be aligned when laid. To do so, the first end of the particular board is secured in the desired position relative to the previously secured board, so that any potential curvature will run away from the previously secured board. Then the board will have to be pulled in across its length for each additional laid board. Due to the often quite large spring force of the floor board, tensioning systems such as tensioning belts, screw clamps or such are often used as auxiliary devices. However, this is associated with the disadvantage that during the particular clamping process and due to the completely undefined and unlimited tension setting of the particular auxiliary device, the joint spacing between the boards has to be controlled with a caliper in order to terminate the tensioning process when the desired joint spacing is obtained. Then the tensioning means actually used has to be left or locked in this state in order to secure the floor board to the sub-floor. This described process has to be repeated several times across the length of the floor board so that the alignment of the floor boards is very complicated and time-consuming.

The object of the present invention is to create an auxiliary device of the stated kind with which the alignment of floor boards—and thus also the laying of plank floors overall—can be carried out faster and simpler.

In the invention this is accomplished by an embodiment as a tensioning unit with two—with respect to the intended application—floor-side, protruding, lower contact jaws for resting against board side edges, said contact jaws being joined together via a displacement guide for changing of their mutual internal distance, and with an upper lever mechanism positioned opposite the lower, floor-side contact jaws, said lever mechanism being designed according to the toggle principle and being connected to the contact jaws such that by pivoting of the lever mechanism the contact jaws can be moved from a starting position with a larger distance into a tensioned position with a smaller, defined distance.

By means of this favorable embodiment, the alignment of floor boards described above is made simpler in that solely the invented tensioning device with the contact jaws need be set onto the already secured floor board and onto the next in line floor board and then be tensioned by using the lever mechanism. Since in the tensioned position directly and necessarily a defined distance of the contact jaws is assured, the cumbersome measuring and monitoring of the particular board joint spacing is unnecessary, so that the board in the tensioned position can be secured immediately to the sub-floor. Consequently, for each additional attachment, solely the tensioning device need be set on and tensioned by a simple movement of the lever. For each individual board attachment, time is saved and this time savings adds up over the plurality of needed attachments and represents a considerable time advantage in the installation of plank floors. In addition, a favorable force transfer is achieved by means of the lever mechanism.

In a favorable embodiment, the tensioning device for adjusting to the particular width of the board and/or to the particular, desired joint spacing, features adjusting means for adjusting of the defined distance of the contact jaws in the tensioned position, so that the distance can be adjusted to a measure which corresponds to twice the width of the particular floor boards plus the width of a desired plank joint. As a rule, a width of joint of 5 to 6 mm is provided for plank floors in outdoor or humid installations, so that at a width of board of 145 mm, for example, a jaw distance of e.g. 295 mm will result for the tensioned setting. Thus an opening stroke of the contact jaws of 20 to 30 mm in all probability will be sufficient in practice, so that the larger jaw distance in the initial setting will be in a range from 315 to 325 mm, for example. However, this data is provided merely as an example and thus does not restrict the invention.

Additional favorable exemplary embodiments of the invention are contained in the following description.

The invention will be explained in greater detail below based on one preferred embodiment illustrated in the figures.

DETAILED DESCRIPTION OF THE DRAWINGS

The same parts are always identified by the same reference symbols in the various figures.

With respect to the following description it is expressly emphasized that the invention is not restricted to the illustrative embodiments and thus not to all or to several features of described feature combinations, rather, each individual sub-feature of drawings may also have an inventive significance individually even detached from all other features, or in combination with other described sub-features of any other exemplary embodiment.

Figure 5:
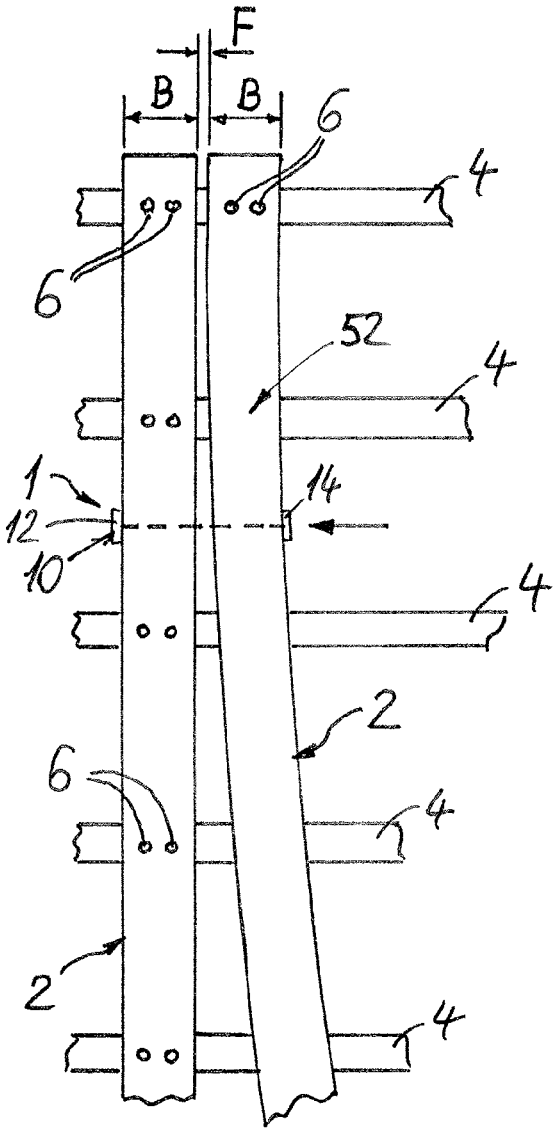

An auxiliary device 1 according to the invention—see also FIG. 5—is used for alignment of floor boards 2 when installing of plank floors, in particular for outdoor areas and in humid areas, and in many cases a sub-floor consisting of several support beams 4 running in parallel is provided to which the individual floor boards 2 are attached, each with a certain joint spacing F, and specifically in particular by means of screws 6. In this case curved, imperfect floor boards 2 each have to be brought into straight alignment.

In accordance with FIGS. 1 to 4, an auxiliary device 1 according to the invention is designed as a tensioning device 10 with two—with respect to the intended application— floor-side, protruding, lower contact jaws 12, 14 for resting against board side edges. These contact jaws 12, 14 are joined together via a displacement guide 16 for changing of their mutual internal distance—in this respect see the distance X1, X2 illustrated FIGS. 3 and 4. The tensioning device 10 additionally features an upper lever mechanism 18 positioned opposite the lower, floor-side contact jaws 12, 14, said lever mechanism is designed according to the toggle principle and is connected to the contact jaws 12, 14 such that by pivoting of the lever mechanism 18 the contact jaws 12, 14 can be moved from a starting position with a larger distance X1—see FIGS. 2 and 4—into a tensioned position with a smaller, defined distance X2—see FIGS. 1 and 3. Of course, the contact jaws 12, 14 can also be brought back into the starting position according to FIGS. 2 and 4 by a corresponding reverse pivot of the lever mechanism. As is particularly evident in FIGS. 3 and 4, the contact jaws 12, 14 run at a slight angle to each other. Thus a reliable application is ensured, because any upward slippage of the board side edges of the contact jaws during tensioning is prevented.

In one preferred embodiment, the tensioning device 10 additionally features adjusting means 19 for adjusting of the defined distance X2 of the contact jaws 12, 14 in the tensioned position. Since according to FIG. 5 the tensioning device 10 with contact jaws 12, 14 spans two floor boards 2 when in use, then by means of the adjusting means 19 a distance can be adjusted which corresponds to twice the width B of the particular floor boards plus the width F of a plank joint; the following relation applies: $X2=2\cdot B+F$.

Preferably the lever mechanism 18 is designed such that in the tensioned position due to passing of a lever dead point it is locked automatically against pivoting back into the starting position. However, the lever mechanism 18 can be moved back into the starting position by forcing it past the dead point.

The displacement guide 16 consists of two guide parts 20, 22 each connected to one of the contact jaws 12, 14 and being joined together in a telescoping, lengthwise displaceable manner.

The lever mechanism 18 consists of a manually pivoting hand lever 24 and a pull lever 26. The hand lever 24 is articulated to a first guide part 20 by means of an end-side, first pivot joint 28, and the pull lever 26 is articulated to the hand lever 24 at a defined distance from the first pivot joint 28 by means of a second pivot joint 30. The pull lever 26 is connected or can be connected to the other, second guide part 22 by its free end positioned opposite the second pivot joint 30. Both pivot joints 28, 30 allow pivoting about one pivot axis, whereby these pivot axes of both pivot joints 28, 30—again in the intended use relative to a floor surface being installed—run firstly parallel to the plane of the floor, and also corresponding to the longitudinal direction of the floor boards 2.

Figure 1:
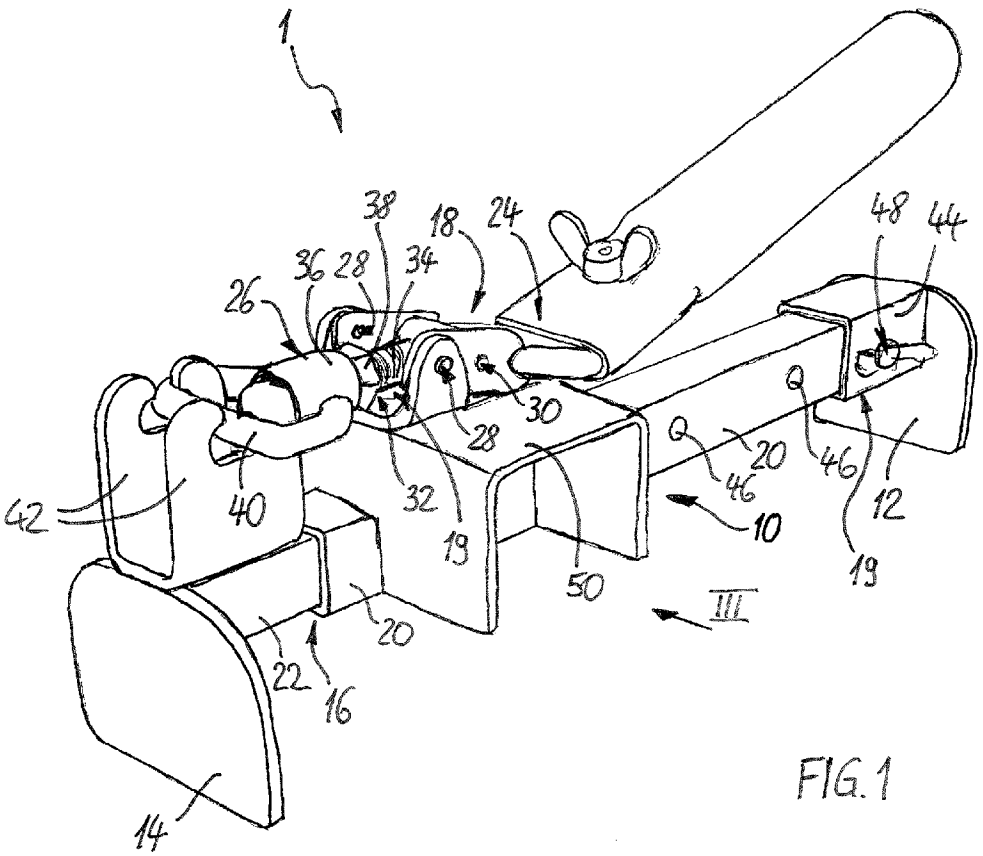
FIG. 1 A perspective view of one preferred design of an invented tensioning device in the tensioned position, FIG. 2 A view analogous to FIG. 1, but in the starting position, FIG. 3 A side view in the tensioned position according to arrow III in FIG. 1, FIG. 4 A side view in the starting position according to arrow IV in FIG. 2, and FIG. 5 A schematic view of a floor area to explain the application of the invented tensioning device when installing and aligning of floor boards of a plank floor.
Figure 2:
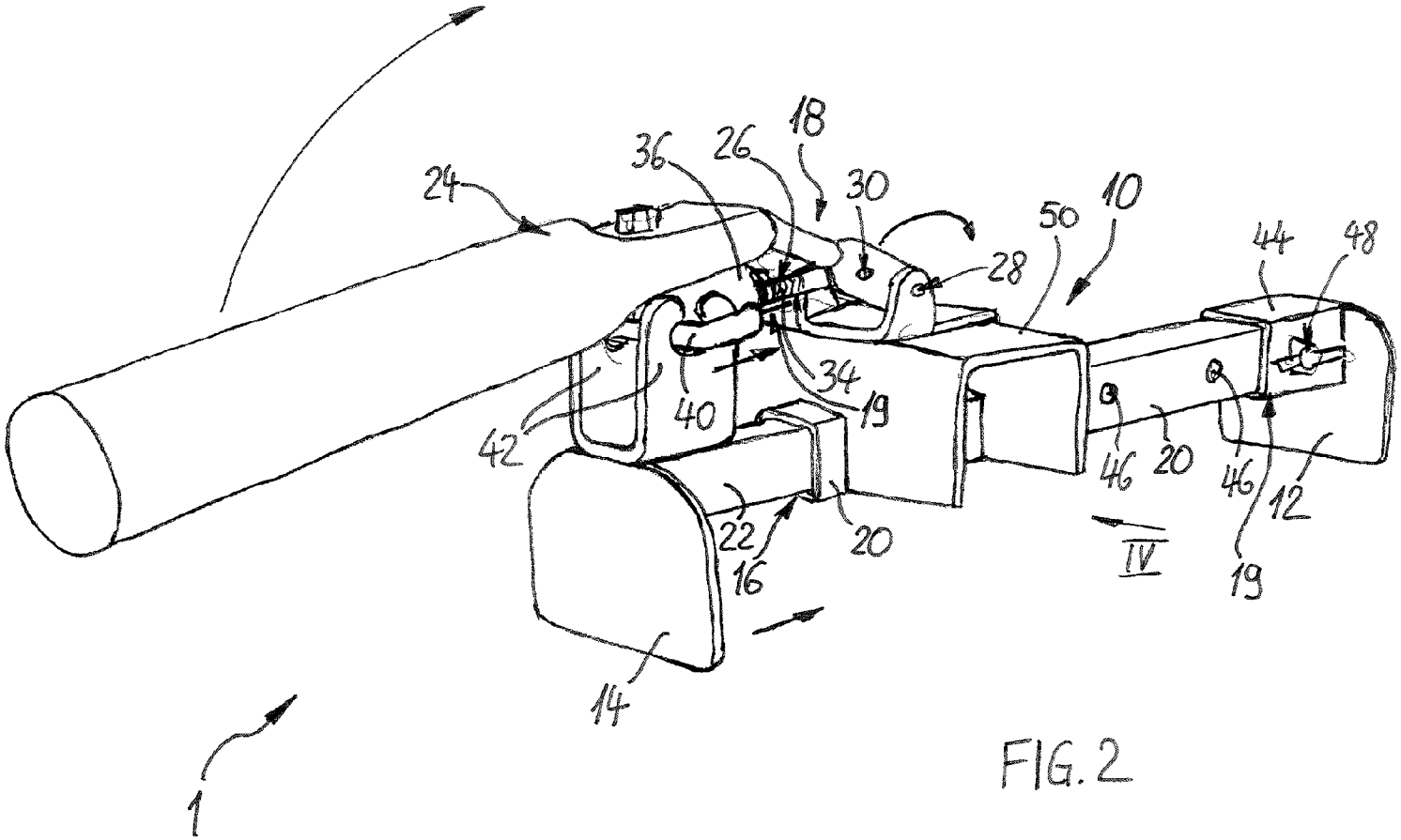
Figures 3, 4:
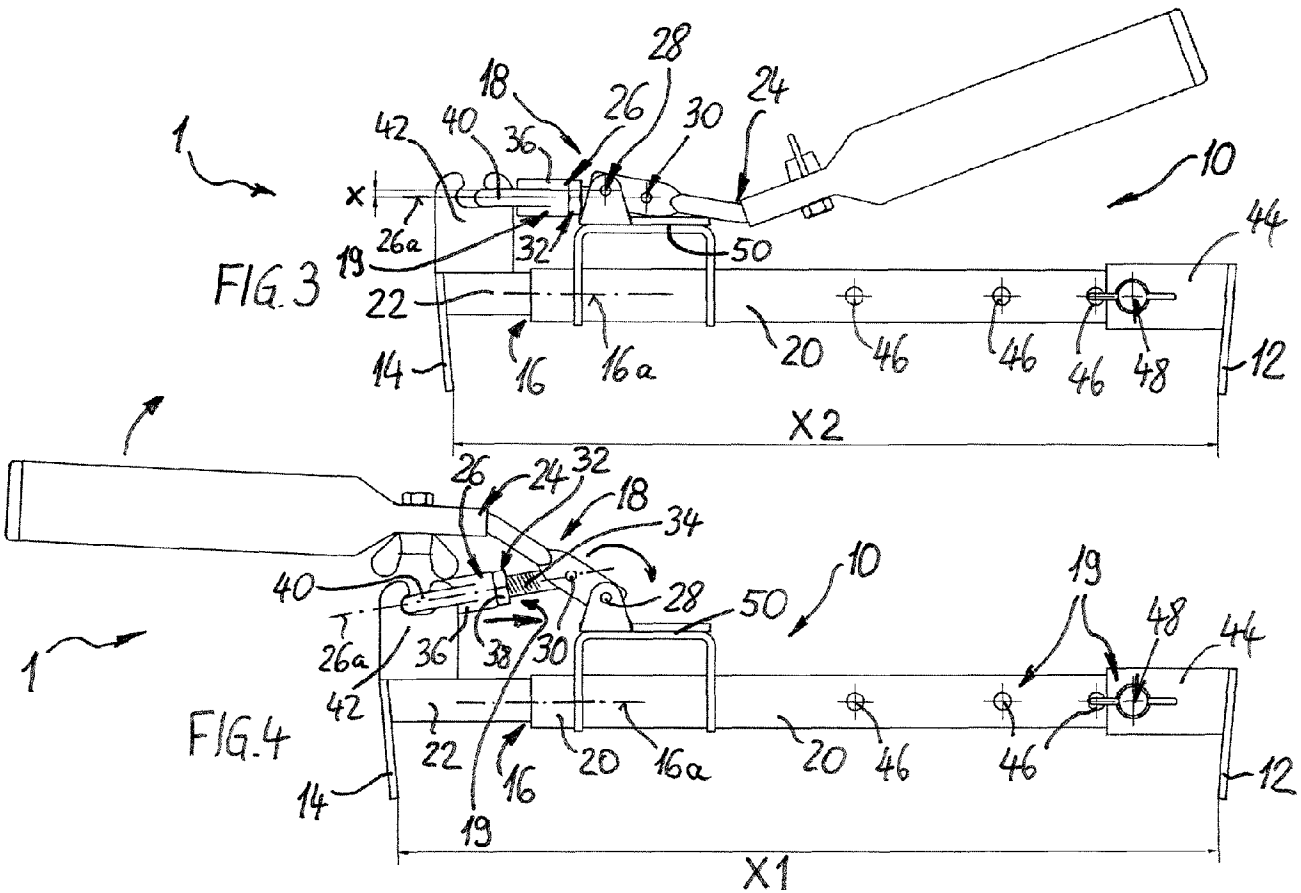

Accordingly, FIG. 3 provides that in the clamped position of the pull lever 26, the longitudinal axis 26*a* thereof runs parallel to an axis of displacement motion 16*a* of the displacement guide 16. The locking due to passing the dead point which was already mentioned briefly above means that according to FIGS. 1 and 3 in its tensioned position the hand lever 24 rests against a mechanical end-stop, whereby then the second pivot joint 30—see in particular FIG. 3—is located by a small amount x underneath the level of the first pivot joint 28. Thus a tensile force acting on the pull lever 26 during the tensioning process can press the hand lever 24 only against the end stop, but not back in the direction of the starting position.

Another favorable embodiment provides that the adjusting means 19 already mentioned briefly above comprise means for fine tuning, for which purpose the pull lever 26 in particular is designed as being length-variable 32 via a screw connection. In the illustrated, preferred embodiment the pull lever 26 consists of a threaded bolt 34 and an end-side lever head 36, whereby the threaded bolt 34 engages in an inner thread of the lever head 36. This screw connection 32 can be locked by means of a locknut 38. The lever head 36 features an eyelet-like hoop element 40 which can be suspended detachably in a receptacle 42 connected to the second guide part 22. The receptacle 42 has a U-shape with two upward-extending side walls, which each have open-edge receptacle openings for suspension of the hoop element 40.

By means of this described embodiment, the pull lever 26 can be suspended in the receptacle 42 in various positions of the hoop element 40 each rotated by 180°. By rotating the hoop element 40 relative to the threaded bolt 34, by means of the screw connection 32 a change in length of the pull lever 26 is created, and specifically as a function of the pitch of the thread of the screw connection 32. If preferably the screw connection 32 is provided with a metric M8-thread, then the pitch will be 1.5 mm, so that due to one-half rotations by 180° each, a change in length of 0.75 mm each will be obtained.

But as an alternative to this described design, a continuous change in length is possible, in that, for example, the pull lever 26 is connected or is connectable to the receptacle 42 by means of a spherical head.

In another preferred embodiment, the adjusting means 19 features additional means for a stepped, coarse adjusting. These additional means are used especially for adapting to different widths B of the floor boards 2. In particular at least one of the two contact jaws 12, 14 is detachably connected to the associated guide part 20—as illustrated, preferably the first contact jaw 12—and is connectable in different distance positions. To do so, the contact jaw 12 can be inserted into the guide part 20 by means of a retaining part 44 and can be locked in different positions for a rough adjustment of the distance. As illustrated, this locking takes place in particular by means of a screw connection guided through transverse holes 46 of the retaining part 44 and of the guide part 20. In this illustrated embodiment the retaining part 44 is pushed onto the guide part 20, whereby to facilitate this pushing onto the guide part 20, the contact jaw 12 features on the front side thereof (not visible in the figures) a passage opening for the guide part 20.

The guide parts 20, 22 of the displacement guide 16 are designed as telescoping hollow profiles engaging into each other, in particular as square tubes. As illustrated, this can be a single guide, but alternatively also a multiple guide is possible, e.g. a double guide with at least two parallel single guides.

The first pivot joint 28 for the hand lever 24 is attached to a bearing console 50 attached to the first guide part 20.

According to FIG. 5, the invented tensioning device 10 permits a simple, fast and convenient application for the alignment of floor boards 2. As is illustrated in FIG. 5, a first, possibly straight floor board 2 is attached to the sub-floor and/or to the support boards 4. A next, potentially imperfect and curved floor board 2 is attached by one first end to the support board 4 at the desired joint spacing F. Before attachment to the next support board 4 at the position 52 according to FIG. 5, the floor board 2 is aligned in a more distant region by means of the schematically illustrated, invented tensioning device 10, in that the tensioning device 10 with its contact jaws 12, 14 is set onto the previously laid floor board 2 and the floor board 2 to be aligned and then tensioned. Then in the defined tensioned setting the attachment can proceed at position 52 immediately, and without verification of the width of joint F. The tensioning device 10 is then moved successively until the floor board 2 is fully secured. When laying the third and additional floor boards the last-laid and secured floor board 2 is always used as reference point and as secure rest for the invented tensioning device 10, that is, the last laid board 2 and the new board to be laid are always spanned, for which purpose one of the contact jaws 12, 14 engages in the joint between the last and the next-to-last board.

Due to the toggle principle of the lever mechanism 18, a favorable force transfer can be achieved in the tensioning process, so that the alignment of the particular floor boards is possible in a convenient manner without any noteworthy exertion.

The invention is not restricted to the illustrated and described exemplary embodiments, but rather encompasses also all equivalent designs within the sense of the invention. It is expressly emphasized that the exemplary embodiments are not restricted to all features in combination, rather each individual sub-feature can have inventive significance by itself detached from all other sub-features. Furthermore, the invention can also be defined by any other combination of specific measures of all disclosed, single features. This means that basically practically each single feature can be omitted or replaced by at least one single feature disclosed elsewhere in the application.

The invention claimed is:

1. An auxiliary device for alignment of floor boards on a floor when laying plank flooring, the auxiliary device being a tensioning unit comprising:

a first floor-side, protruding, lower contact jaw and a second floor-side, protruding, lower contact jaw, the first contact jaw and the second contact jaws being configured for resting against board side edges, a displacement guide connecting the first and second contact jaws, the displacement guide being configured for varying the distance between the first contact jaw and the second contact jaw, the displacement guide consisting of first and second guide parts connected to a respective one of the first and second contact jaws and connected to each other in a telescoping, length-displaceable manner, an upper lever mechanism positioned longitudinally between the first and second contact jaws, the lever mechanism being configured to operate according to a toggle principle and being connected to the first and second contact jaws such that by pivoting of the lever mechanism, the first and second contact jaws are moved from a starting position with a first jaw distance from each other into a tensioned position with a second, defined jaw distance from each other, the first jaw distance being greater than the defined jaw distance, adjusting means for adjusting of the defined jaw distance of the contact jaws in the tensioned position, the adjusting means including a fine adjustment means for varying a length of a pull lever via a screw connection and a stepped rough adjustment means, wherein the pull lever has an eyelet-like hoop element at a free end, the hoop element configured to be detachably suspended in a receptacle connected to the second guide part so that the hoop element is rotatable for fine adjustment of the screw connection in a detached state and wherein for rough adjustment, the first contact jaw connected to the first guide part is configured to be connected to the first guide part via a retaining part and to be locked in different positions for a rough adjustment of the defined jaw distance.

2. The auxiliary device according to claim 1, wherein the defined jaw distance in the tensioned position corresponds to twice the width of selected floor boards plus the width of a joint spacing.

3. The auxiliary device according to claim 1, further comprising that the lever mechanism has a dead point that prevents the lever mechanism from pivoting from the tensioned position to the starting position without applying an external force.

4. The auxiliary device according to claim 1, wherein the lever mechanism comprises a manually pivoting hand lever and the pull lever, the hand lever being connected in an articulated manner to the first guide part via an end-side, first pivot joint, and the pull lever being connected in an articulated manner to the hand lever at a defined joint distance from the first pivot joint via a second pivot joint, the pull lever being configured to be connected to the second guide part at a pull lever end positioned opposite the second pivot joint via the eyelet-like hoop element.

5. The auxiliary device according to claim 4, wherein the pull lever has a free end with an eyelet-like hoop element which can be detachably suspended in a receptacle connected to the second guide part.

6. The auxiliary device according to claim 4, wherein the first pivot joint for the hand lever is attached to a bearing console connected to the first guide part.

7. The auxiliary device according to claim 4, wherein in the tensioned position, the pull lever has a longitudinal axis extending parallel to an axis of displacement of the displacement guide.

8. The auxiliary device according to claim 1, wherein the guide parts of the displacement guide are telescoping hollow profiles engaging into each other.

9. The auxiliary device according to claim 8, wherein the guide parts are tubes with a rectangular cross-section.

10. The auxiliary device according to claim 1, wherein the first contact jaw is locked in the first guide part via a screw connection guided through transverse holes of the retaining part and of the first guide part.

* * * * *